US007596492B2

(12) United States Patent
Sung et al.

(10) Patent No.: US 7,596,492 B2
(45) Date of Patent: Sep. 29, 2009

(54) APPARATUS AND METHOD FOR CONCEALING HIGHBAND ERROR IN SPLIT-BAND WIDEBAND VOICE CODEC AND DECODING

(75) Inventors: Jongmo Sung, Daejon (KR); Do-Young Kim, Daejon (KR)

(73) Assignee: Electronics and Telecommunications Research Institute (KR)

( * ) Notice: Subject to any disclaimer, the term of this patent is extended or adjusted under 35 U.S.C. 154(b) by 872 days.

(21) Appl. No.: 10/943,118

(22) Filed: Sep. 15, 2004

(65) Prior Publication Data

US 2005/0143985 A1 Jun. 30, 2005

(30) Foreign Application Priority Data

Dec. 26, 2003 (KR) ..... 10-2003-0097824

(51) Int. Cl.
*G10L 19/12* (2006.01)

(52) U.S. Cl. ..... 704/223; 704/220; 704/219; 704/200

(58) Field of Classification Search ..... 704/230, 704/200, 220, 219, 223
See application file for complete search history.

(56) References Cited

U.S. PATENT DOCUMENTS

| | | | | |
|---|---|---|---|---|
| 5,884,010 | A | 3/1999 | Chen et al. | |
| 2002/0072901 | A1 * | 6/2002 | Bruhn | 704/229 |
| 2004/0010407 | A1 * | 1/2004 | Kovesi et al. | 704/219 |
| 2004/0078194 | A1 * | 4/2004 | Liljeryd et al. | 704/200.1 |
| 2005/0004793 | A1 * | 1/2005 | Ojala et al. | 704/219 |
| 2005/0154584 | A1 * | 7/2005 | Jelinek et al. | 704/219 |

FOREIGN PATENT DOCUMENTS

| | | |
|---|---|---|
| KR | 2003-0046510 | 6/2003 |
| WO | WO 00/63885 | 10/2000 |

OTHER PUBLICATIONS

Kai Cluver et al., "Reconstruction of Missing Speech Frames Using Sub-Band Excitation," IEEE Proc. of the IEEE-SP Int'l Symp. On TFTS analysis (pp. 277-280) 1996.

Juan Carlos De Martin et al., "Improved Frame Erasure Concealment For Celp-Based Coders," IEEE ICASSP 00, vol. 3, (pp. 1483-1486), 2000.

Jean-Marc et al., "Bandwidth Extension of Narrowband Speech For Low Bit-Rate Wideband Coding," IEEE Workshop on Speech Coding 2000 (pp. 130-132) 2000.

* cited by examiner

*Primary Examiner*—Qi Han
(74) *Attorney, Agent, or Firm*—Blakely, Sokoloff, Taylor & Zafman

(57) ABSTRACT

An apparatus for concealing a highband error in a spilt-band wideband voice codec in accordance with the present invention is disclosed. The apparatus includes: a lowband LPC coefficient extracting unit for extracting a lowband linear predictive coding (LPC) coefficient from a lowband voice signal passed by a lowband decoding unit; a highband excitation signal generating unit for generating a highband excitation signal based on the lowband voice signal and the lowband LPC coefficient; a highband LPC coefficient generating unit for generating a highband LPC coefficient based on the lowband LPC coefficient; a highband voice synthesizing unit for synthesizing a highband voice signal based on the highband excitation signal and the highband LPC coefficient; and a high pass filtering unit for removing a lowband component of the synthesized highband voice signal by the highband voice synthesis unit and generating the synthesized highband voice signal.

10 Claims, 5 Drawing Sheets

APPARATUS AND METHOD FOR CONCEALING HIGHBAND ERROR IN SPLIT-BAND WIDEBAND VOICE CODEC AND DECODING

FIELD OF THE INVENTION

The present invention relates to an apparatus and method for restoring a packet loss and a frame error in a spilt-band voice codec and a decoding system using the same; and, in particular, to an apparatus for restoring a voice corresponding to highband in a spilt-band wideband voice codec when an error packet or a lost packet are occurred.

DESCRIPTION OF RELATED ART

A technology for transmitting an analog voice as a digital streaming is generally used in not only a conventional public switched telephone network (PSTN) but a wireless network and a voice over internet protocol (VOIP) network getting popular in recent. If a voice is simply sampled and digitalized, for example, sampled in 8 kHz and coded in an 8 bit per sample, 64 kbit/s is required. However, if a proper voice analysis and coding scheme are used in voice compression, the transmission rate of the voice can be decreased.

As mentioned above, a voice codec is an apparatus for compressing a voice to a digital bit stream and expanding a digital bit stream to a voice. Currently, most conventional voice codecs are narrowband codec, and used for encoding and decoding a voice ranging from 300 Hz to 3,400 Hz. However, for providing better voice quality than that of the conventional narrowband voice codec, a wideband voice codec encoding and decoding the voice signal ranging from 50 Hz to 7000 Hz becomes prominent. Over the past few years, wideband voice codecs were standardized by International Telecommunication Union-Telecommunication (ITU-T), 3rd Generation Partnership Project (3GPP), 3rd Generation Partnership Project 2 (3GPP2), etc. A spilt-band wideband voice codec is one type of the wideband voice codecs, splits the overall bandwidth ranging from 50 Hz to 7,000 Hz of the voice signal into two bands as lowband and highband, and encodes each band separately. This type of voice codec can adopt different coding schemes for each band, e.g., Code-Excited Linear Prediction (CELP) coding for lowband and Transform coding for highband.

FIG. 1 is a block diagram illustrating a conventional spilt-band voice codec system.

As shown, in a transmitting part, an input voice signal 100 sampled in 16 kHz is split into a lowband voice signal and a highband voice signal which have the same sampling frequency as the input voice signal 100 by passing the input voice signal 100 through a low pass filter (LPF) 111 and a high pass filter (HPF) 121 respectively. A 16 kHz lowband voice signal is converted into an 8 kHz lowband voice signal by a down-sampler 112 and a 16 kHz highband voice signal is also converted into an 8 kHz highband voice signal by a down-sampler 122 in the same way. The 8 kHz lowband voice signal is encoded to a lowband bit stream by a lowband encoder 113 and the 8 kHz highband voice signal is encoded to a highband bit stream by a highband encoder 123. The lowband bit stream and the highband bit stream are multiplexed into a wideband bit stream by a multiplexer 150 and the wideband bit stream 101 is transmitted through a channel 160.

In the receiving part, the wideband bit stream 102 transmitted through the channel 160 is demultiplexed into a lowband bit stream and a highband bit stream by a demultiplexer 170. The lowband bit stream is decoded to a 8 kHz lowband voice signal by a lowband decoder 131 and the highband bit stream is decoded to a 8 kHz highband voice signal by a highband decoder 141. The 8 kHz lowband voice signal is converted into a 16 kHz lowband voice signal by an up-sampler 132 and the 8 kHz highband voice signal is converted into a 16 kHz voice signal by an up-sampler 142. A highband component of the 16 kHz lowband voice signal is removed by a LPF 133 and a lowband component of the 16 kHz highband voice signal by a HPF 143. Finally, the 16 kHz lowband and highband voice signals are combined by a combiner 180 thereby a synthesized voice signal 103 is generated.

The spilt-band wideband voice codec can adopt different coding scheme (e.g., Pulse Coded Modulation (PCM), CELP coding, Transform coding, etc) for each band independently. For example, a spilt-band wideband voice codec can use the CELP for the lowband and the transform coding for the highband.

Most of the conventional voice codecs adopt a packet loss concealment algorithm or a frame erasure concealment algorithm so that copes with the packet loss and the frame error.

However, these algorithms can be mostly applied to the narrowband voice codecs and depend on adopted voice encoding method. As mentioned above, the spilt-band wideband voice codec generally adopts different voice coding methods for the lowband and the highband. Therefore, the codec has a drawback of designing an additional error concealment method according to the adopted highband coding method.

SUMMARY OF THE INVENTION

It is, therefore, an object of the present invention to provide an apparatus and method for concealing a packet loss and a frame error in a highband of a spilt-band wideband voice codec so that provides a high quality voice communication and a bit stream decoding system using the same.

In accordance with an aspect of the present invention, there is provided an apparatus for concealing a highband error in a spilt-band wideband voice codec, the apparatus including: a lowband LPC coefficient extracting unit for extracting a lowband linear predictive coding (LPC) coefficient from a lowband voice signal passed by a lowband decoding unit; a highband excitation signal generating unit for generating a highband excitation signal based on the lowband voice signal and the lowband LPC coefficient; a highband LPC coefficient generating unit for generating a highband LPC coefficient based on the lowband LPC coefficient; a highband voice synthesizing unit for synthesizing a highband voice signal based on the highband excitation signal and the highband LPC coefficient; and a high pass filtering unit for removing a lowband component of the synthesized highband voice signal by the highband voice synthesizing unit and generating the synthesized highband voice signal.

In accordance with another aspect of the present invention, there is provided a method for concealing a highband error in spilt-band wideband voice codec, the method including the steps of: extracting a lowband linear predictive coding (LPC) coefficient from a lowband voice signal transmitted from a lowband decoding unit; generating a highband excitation signal based on the lowband voice signal and the lowband LPC coefficient; generating a highband LPC coefficient based on the lowband LPC coefficient; synthesizing a highband voice signal based on the highband excitation signal and the highband LPC coefficient; and removing a lowband component of the synthesized highband voice signal passed by the highband voice synthesizing unit and outputting the synthesized highband voice signal.

In accordance with still another aspect of the present invention, there is provided a bit stream decoding system using an apparatus for concealing a highband error, the system including: a packet loss detecting unit for detecting a packet loss of an input bit stream; a demultiplexing unit for demultiplexing the input bit stream into a highband bit stream and a lowband bit stream by analyzing the input stream for every frame; a lowband decoding unit for decoding the lowband bit stream passed from the demultiplexing unit into a lowband voice signal; a highband error detecting unit for detecting a highband error by checking the highband bit stream passed from the demultiplexing unit and determining whether the input bit stream has a error; a first selecting unit for selecting an apparatus to decode the highband bit stream based on outputs of the packet loss detecting unit and the highband error detecting unit; a highband error concealing unit for concealing an error in a highband frame or lost frame; a second selecting unit for selecting an apparatus to output a synthesized highband voice based on the outputs of the packet loss detecting unit and the highband error detecting unit; and a combining unit for outputting a synthesized wideband voice signal by combining the synthesized lowband voice signal and the synthesized highband voice signal.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Herein after, an apparatus for concealing highband error in spilt-band wideband voice codec and a method thereof will be described in detail with reference to the accompanying drawings.

Figure 1:
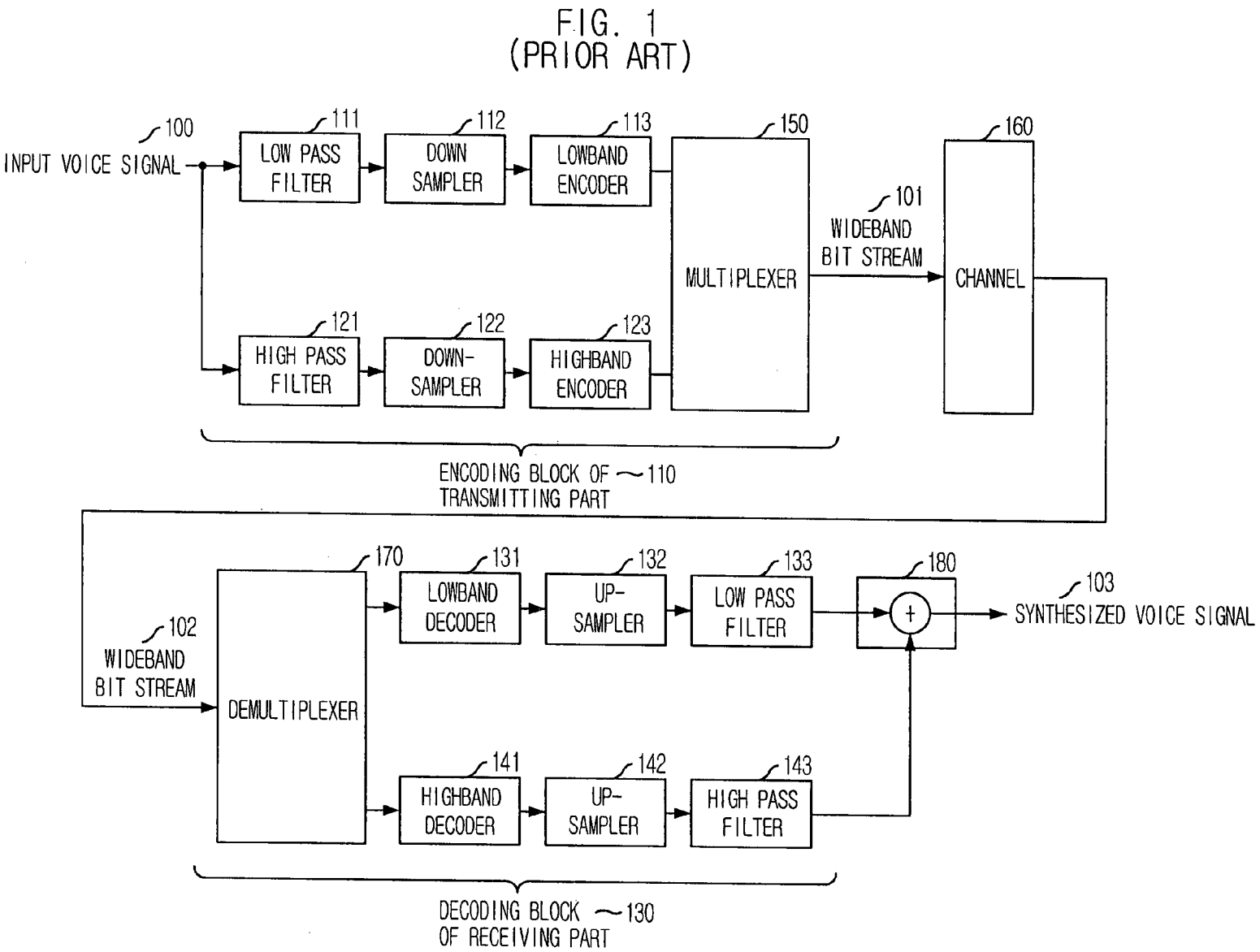
FIG. 1 (PRIOR ART)
FIG. 1 is a block diagram showing a conventional spilt-band voice codec system.
Figure 2:
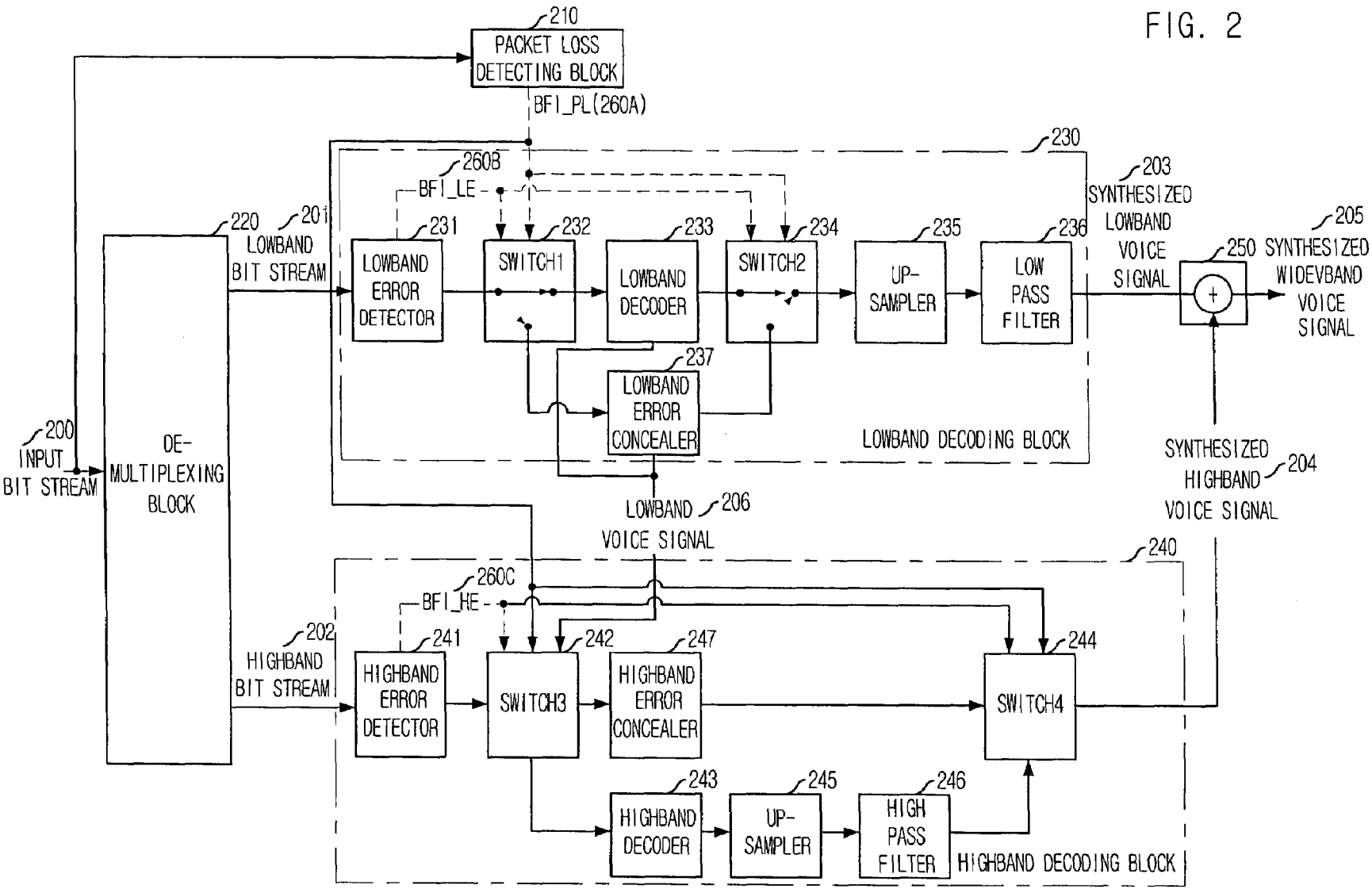
FIG. 2 is a block diagram illustrating a bit stream decoding system using an apparatus for concealing a highband error in the spilt-band wideband voice codec in accordance with a preferred embodiment of the present invention.

FIG. 2 is a block diagram illustrating a bit stream decoding system using an apparatus for concealing a highband error in the spilt-band wideband voice codec in accordance with a preferred embodiment of the present invention.

As shown, the bit stream decoding system includes a packet loss detecting block 210, a demultiplexing block 220, a lowband decoding block 230, a highband decoding block 240 and a combiner 250.

The packet loss detecting block 210 detect whether the packet transmitted over the channel is lost or not. The packet loss detecting block 210 generates a Bad Frame Indicator for the Packet Loss (BFI_PL) 260A signal based on the detecting result. The demultiplexing block 220 receives the input bit stream 200 and demultiplexes the input stream 200 into a lowband bit stream 201 and a highband bit stream 202 by analyzing the input stream 200 on a frame by frame basis. The lowband decoding block 230 receives the lowband bit stream 201 and the BFI_PL 260A, and then decodes lowband bit stream into a lowband voice signal 206 or conceals lost and erroneous lowband frames thereby generates a synthesized lowband voice signal 203 and transmits the lowband voice signal 206 to a highband error concealer 247 of the highband decoding block 240. The highband decoding block 240 receives the highband bit stream 202, the BFI_PL 260A and the synthesized lowband voice signal 206, and then decodes the highband bit stream 202 into a highband voice signal or conceals lost and erroneous highband frames thereby generates a synthesized highband voice signal 204.

The combiner 250 generates a synthesized wideband voice signal 205 by combining the synthesized lowband voice signal 203 and the synthesized highband voice signal 204.

As shown, the packet loss detecting block 210 determines whether a packet is lost or not according to a state of the packet during a transmission of the packet. If the packet loss is occurred, the packet loss detecting block 210 sets a bad frame indicator for the packet loss signal (BFI_PL) 260A to 1. If the packet loss doesn't occur, the packet loss detecting block 210 sets BFI_PL 260A to 0.

The lowband decoding block 230 includes a lowband error detector 231, a first switch 232, a lowband decoder 233, a lowband error concealer 237, a second switch 234, an upsampler 235 and a low pass filter 236.

The lowband error detector 231 determines whether an error is occurred in the lowband bit stream 201 or not by analyzing the lowband bit stream 201. Conventionally, the analysis procedure is done by checking the Cyclic Redundancy Code CRC). If there is an error in the lowband bit stream 201, the lowband bit stream detector 231 sets a bad frame indicator for lowband error signal (BFI_LE) 260B to 1. If there is no error, the lowband bit stream detector 231 sets the BFI_BE 260B to 0.

The first switch 232 operates based on values of the BFI_PL 260A and the BFI_LE 260B. If both of them are 0, i.e., there is no lowband error frame and no packet loss of the input bit stream 200, the first switch 232 transmits the lowband bit stream 201 to the lowband decoder 232 and enables the lowband decoder 231. Otherwise, i.e., if there is a lowband error frame or a packet loss of the input bit stream 200, the first switch 232 enables the lowband error concealer 237.

The lowband decoder 233 decodes the lowband bit stream 201 into a lowband voice signal 206 based on a predetermined decoding method and transmits the lowband voice signal 206 to a third switch 242 of the highband decoding block 240 for concealing the highband error of the input bit stream 200.

The lowband error concealer 237 recovers the lowband voice signal 206 for the erroneous frame or lost frame using information stored from the previous frame. The lowband error concealer 237 transmits the restored lowband voice signal 206 to the third switch 242 of the highband decoding block 240 for concealing the highband error of the input bit stream 200.

The second switch 234 selects one of the lowband voice signal 206 from the lowband decoder 233 and the restored lowband voice signal 206 from the lowband error concealer 237 based on the BFI_PL 260A and the BFI_LE 260B in the same switching manner of the first switch 232. If both of the BFI_PL 260A and the BFI_LE 260 B are 0, the second switch 234 transmits the lowband voice signal 203 to the up-sampler 235. Otherwise, the second switch 234 transmits the restored lowband voice signal to the up-sampler 235.

The up-sampler 235 receives the lowband voice signal 206 from the lowband decoder 233 or the lowband error concealer 237 and converts the sampling rate of the lowband voice signal from 8 kHz into 16 kHz.

The low pass filter 235 receives the 16 kHz lowband voice signal, removes an unnecessary highband component of the 16 kHz lowband voice signal and generates the synthesized lowband voice signal 203.

The highband decoding block 240 includes a highband error detector 241, a third switch 242, a highband decoder 243, a forth switch 244, a second up-sampler 245, a high pass filter 246 and a highband error concealer 247.

The highband error detector 241 determines whether an error is occurred in the highband bit stream 202 or not by analyzing the highband bit stream 202. This is usually done by the CRC check. If there is an error in the highband bit stream 202, the highband bit stream detector 241 sets a bad frame indicator for highband error signal (BFI_HE) 260C to 1. If there is no error, the highband error detector 241 sets BFI_HE 260C to 0.

The third switch 242 selects block to be enabled based on the values of the BFI_PL 260A and the BFI_HE 260C. If both of them are 0, i.e., there is no highband error frame and no packet loss of the input bit stream 200, the third switch 243 enables the highband decoder 242. Otherwise, i.e., there is a highband error frame or a packet loss of the input bit stream 200, the third switch 243 enables the highband error concealer 247.

The highband error concealer 247 receives the lowband voice signal 206 from the lowband decoder 233 or the lowband error concealer 237, recovers the highband voice signal from the lowband voice signal 206 and transmits the synthesized highband signal to the forth switch 244.

The highband decoder 243 decodes the highband bit stream 202 into a highband voice signal based on the predetermined decoding method.

The second up-sampler 245 converts the sampling rate of the highband voice signal from 8 kHz into 16 kHz.

The high pass filter 246 removes an unnecessary lowband component of the 16 kHz highband voice signal and transmits the filtered highband voice signal to the forth switch 244.

The forth switch 244 selects one of the restored highband voice signal of the highband error concealer 247 and the filtered highband voice signal of the high pass filter 246 based on the BFI_PL 260A and the BFI_HE 260C. If the BFI_PL 260A and the BFI_HE 260C are 0, the forth switch 244 transmits the filtered 16 kHz highband voice signal as the synthesized highband voice signal 204 to the combiner 250. Otherwise, the forth switch 244 transmits the restored highband voice signal as the synthesized highband voice signal 204 to the combiner 250.

Figure 3:
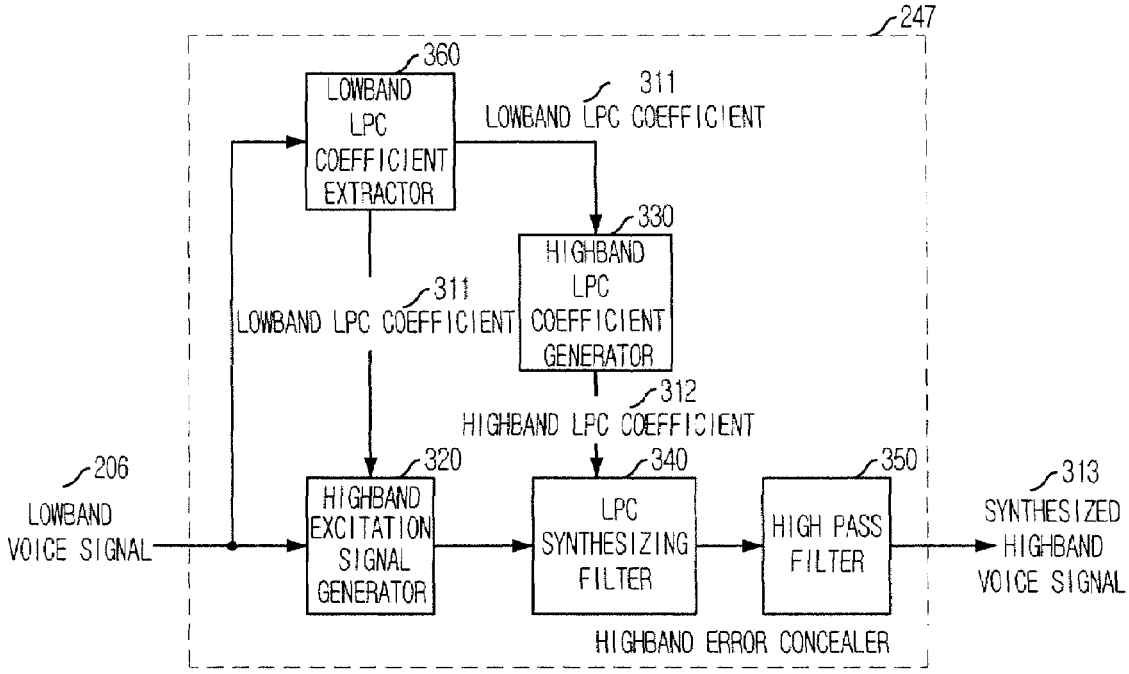
FIG. 3 is a block diagram describing an apparatus for concealing a highband error in the spilt-band wideband voice codec in accordance with a preferred embodiment of the present invention.

FIG. 3 is a block diagram describing an apparatus for concealing a highband error in the spilt-band wideband voice codec in accordance with a preferred embodiment of the present invention.

As shown, the apparatus includes a lowband LPC coefficient extractor 360, a highband LPC coefficient generator 330, a highband excitation signal generator 320, a LPC synthesizing filter 340 and a high pass filter 350.

The lowband LPC coefficient extractor 360 extracts a lowband linear predictive coding (LPC) coefficient 311 from the lowband voice signal 206 transmitted from the lowband decoding block 230. The highband LPC coefficient generator 330 receives the lowband LPC coefficient 311 and generates a highband LPC coefficient 312, and then transmits the highband LPC coefficients to the LPC synthesis filter 340. The highband excitation signal generator 320 receives the lowband voice signal 206 and the lowband LPC coefficient 311 and generates a 16 kHz highband excitation signal. The LPC synthesizing filter 340 receives the highband excitation signal and the highband LPC coefficient 312 and synthesizes a highband voice signal, and then transmits a synthesized highband voice signal to the high pass filter 350. The high pass filter 350 removes an unnecessary lowband component of the synthesized highband voice signal and generates the synthesized highband voice signal 313.

The LPC synthesizing filter 340 is generally expressed in Eq. 1 as below.

$$A(z) = \frac{1}{1 + \sum_{i=1}^{p} a_i z^{-i}} \quad \text{Eq. (1)}$$

Wherein $\alpha_i$ is an ith highband LPC coefficient and p is a LPC order.

Figure 4A:
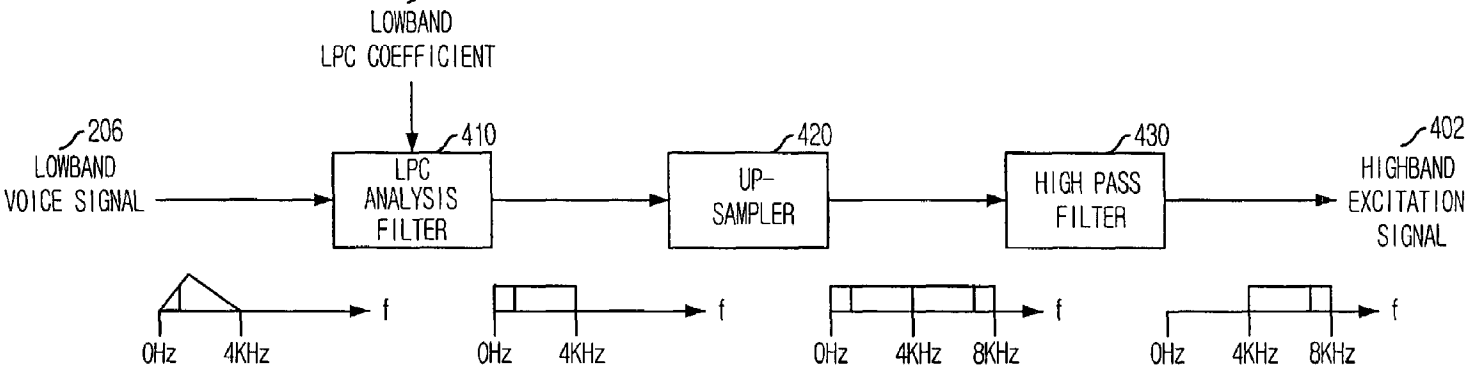
FIGS. 4A and 4B are block diagrams showing an highband excitation signal generator of the apparatus for concealing a highband error in accordance with a preferred embodiment of the present invention.
Figure 4B:
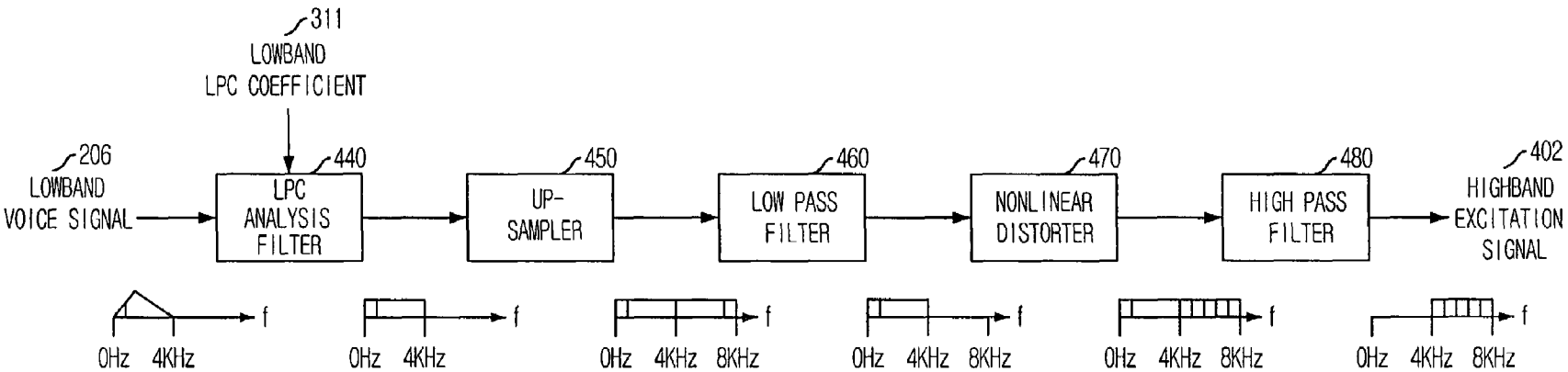

FIGS. 4A and 4B are block diagrams showing examples of the highband excitation signal generator 320 of the apparatus for concealing a highband error in accordance with a preferred embodiment of the present invention. The drawings illustrate processes of a spectral folding method and a nonlinear distortion method respectively for generating the highband excitation signal 402 from the lowband voice signal 206 by the highband excitation signal generator 320.

Herein, both of the two methods are based on the fact that the highband of a voice is highly correlated to the lowband. Figures located between blocks describe a typical spectral form of each signal and a horizontal axis (f) means a frequency.

FIG. 4A shows the highband excitation signal generator 320 using the spectral folding method. The highband excitation signal generator 320 includes a LPC analysis filter 410, an up-sampler 420 and a high pass filer 430.

The LPC analysis filter 410 is operated based on the lowband LPC coefficients 311, generates an 8 kHz lowband excitation signal from the 8 kHz lowband voice signal 206 and is an inverse-filter of Eq. 1 as expressed as below.

$$B(z) = 1 + \sum_{i=1}^{p} b_i z^{-i} \quad \text{Eq. (2)}$$

Wherein $b_i$ is an ith lowband LPC coefficient and p is a LPC order.

The spectrum of the 8 kHz lowband excitation signal has a flat shape in a frequency domain due to whitening process of the LPC analysis filter 410.

The up-sampler 420 increases the sampling frequency of the lowband excitation signal from 8 kHz to 16 kHz. Consequently, the up-sampler 420 creates the mirror image folded at 4 kHz of the lowband spectrum in highband.

Finally, the high pass filter 430 removes an unnecessary lowband component of the up-sampled excitation signal and generates a highband excitation signal 402.

FIG. 4B is the highband excitation signal generator 320 using the nonlinear distortion method. The highband excitation signal generator 320 includes a LPC analysis filter 440, an up-sampler 450, a low pass filter 460, a nonlinear distorter 470 and a high pass filter 480.

The LPC analysis filter 440 is constructed using the lowband LPC coefficients 311, generates a 8 kHz lowband excitation signal from the 8 kHz lowband voice signal 206 and is expressed as Eq. 2. The spectrum of the 8 kHz lowband excitation signal has a flat shape in a frequency domain.

The up-sampler 450 increases the sampling frequency of the lowband excitation signal from 8 kHz to 16 kHz.

The low pass filter 460 removes a highband component of the up-sampled excitation signal and generates a filtered lowband excitation signal.

The nonlinear distorter 470 adds a highband component to the filtered lowband excitation signal using the nonlinear functions like a square function or an absolute function, and generates a distorted excitation signal which is in phase with the lowband excitation signal and conserves a harmonic structure of the lowband excitation signal without a spectral distortion.

The high pass filter 480 removes a lowband component from the distorted excitation signal and generates a highband excitation signal 405.

Figure 5:
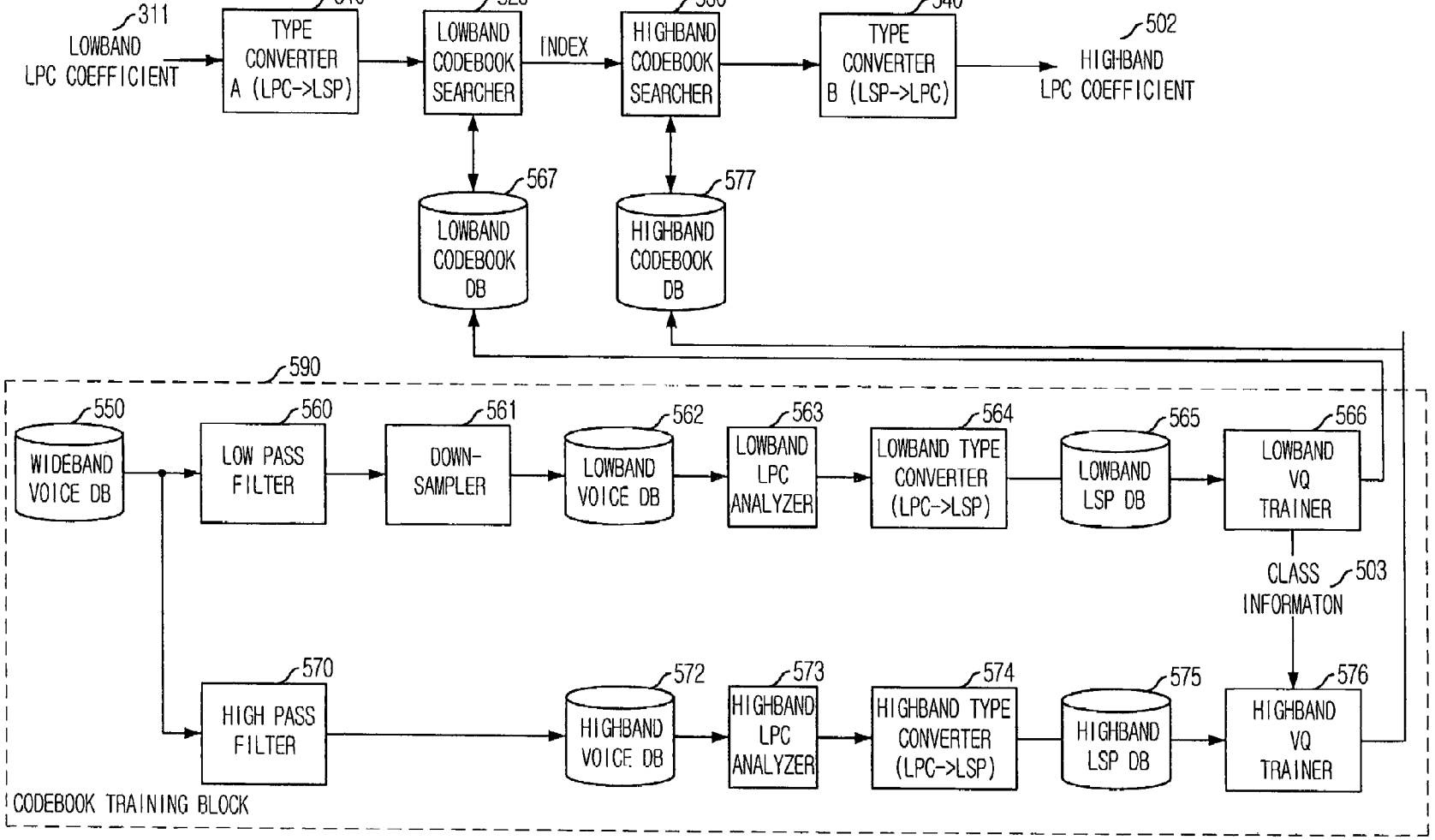
FIG. 5 is a block diagram showing a highband LPC coefficient generator of the apparatus for concealing a highband error in accordance with a preferred embodiment of the present invention.

FIG. 5 is a block diagram showing a highband LPC coefficient generator 330 of the apparatus for concealing a highband error in accordance with an embodiment of the present invention and illustrating a process for extrapolating a highband LPC coefficient 502 from the lowband LPC coefficient 311.

As shown, the highband LPC coefficient generator 330 includes a type converter A 510, a lowband codebook searcher 520, a highband codebook searcher 530, a type converter B 540, a lowband codebook 567, and a highband codebook 577.

The type converter A 510 converts the type of the lowband coefficients 311 from LPC to line spectral pair (LSP). The LSP is more convenient type for searching a codeword in a codebook. The lowband codebook searcher 520 searches a most similar codeword vector to the lowband LSP coefficients vector in the lowband codebook 567 and outputs its codeword index as a searched one. The highband codebook searcher 530 searches a highband LSP codeword corresponding to the searched index in a lowband codebook 577. The type converter B 540 converts the highband LSP codeword searched by the highband codebook searcher 530 into highband LPC coefficients 502. The lowband codebook 567 stores lowband LSP codeword vectors trained by the codebook training block 590. The highband codebook 577 stores highband LSP codeword vectors trained by the codebook training block 590. The codebook training block 590 trains the lowband LSP coefficient vectors and the highband LSP coefficient vectors simultaneously.

The detail operation of the highband LPC coefficient generator 330 will be described hereinafter.

The type converter A 510 converts the lowband LPC coefficient 311 into the same type of the codeword in the codebook. The LSP is used as a codeword in this embodiment and the type converter 510 converts the lowband LPC coefficient 311 into a lowband LSP coefficient.

The lowband codebook searcher 520 searches the nearest codeword with the converted lowband LSP coefficient in the lowband codebook 567 and outputs an index of the codeword. The method for searching a codebook is based on a distance measurement as Eq. 3 and selects a codeword having nearest distance value among all codewords existing in the codebook.

$$\text{index} = arg_{cw}\max D(l_{in}, l_{cw}) = arg_{cw}\max\sum_{i=1}^{p}(l_{in}, l_{cw})^2 \quad \text{Eq. (3)}$$

Wherein, $l_{in}$ is an input LSP coefficient vector with a order of p, $l_{cw}$ is a codeword vector of a codebook with a order of p and p is a order of a vector. cw is a codeword index.

The codebook searcher 530 searches the highband codebook 577 in the highband codebook 577 corresponding to the index 501 searched by the lowband codebook searcher 520 and outputs a codeword corresponding to the highband LSP.

The type converter B 540 converts the highband LSP coefficient into a highband LPC coefficient 502.

The lowband codebook 567 and the highband codebook 577 are trained beforehand in offline.

The codebook training block 590 includes a wideband voice data base (DB) 550, a low pass filter 560, a down-sampler 561, a lowband voice DB 562, a lowband LPC analyzer 563 a lowband type converter 564, a lowband LSP DB 565, a lowband vector quantizer 566, a high pass filter 570, a highband voice DB 572, a highband LPC analyzer 573, a highband type converter 574, a highband LSP DB 575 and a highband vector quantizer 576.

The detail operation of the codebook training block 590 will be described hereinafter.

The wideband voice DB 550 stores 16 kHz wideband voice materials.

The low pass filter 560 removes a highband component for every 16 kHz wideband voice samples and generates lowband voice samples in 16 kHz, and then passes the samples to the down-sampler 561.

The down-sampler 561 converts a sampling frequency of the lowband voice samples from 16 kHz into 8 kHz and generates 8 kHz lowband voice samples. These 8 kHz lowband voice samples are stored in the lowband voice DB 562.

The lowband LPC analyzer 563 performs a LPC analysis for lowband voice frames and generates lowband LPC coefficients for the frame.

The lowband type converter 564 converts the lowband LPC coefficients vector analyzed by the lowband LPC analyzer 563 into a lowband LSP vector which is a parameter type proper to vector quantization. By repeating the process from the lowband LPC analyzer 563 to the lowband type converter 564 for every frame of all the 8 kHz lowband voice samples in the lowband voice DB 562, the lowband LSP DB 565 is created. The lowband LSP DB 565 stores the LSP coefficients vectors for all of the 8 kHz lowband voice samples in the lowband voice DB 562 as training set.

The lowband vector quantization (VQ) trainer 566 separates the lowband LSP DB 565, the training data into groups representing classes and then calculates the representatives of the classes. The lowband codebook is the set of the representatives. A Linde, Buzo, Gray (LBG) algorithm or Liyod algorithm is generally used as a training algorithm. Class information corresponding to each LSP coefficient vector obtained additionally by the lowband VO trainer 566 are passed to the highband VO trainer 576.

In similar to the process for generating the lowband codebook 567, the high pass filter 570 removes a lowband component from the 16 kHz wideband voice samples and generates 16 kHz highband voice samples. The 16 kHz highband voice samples are stores at the highband voice DB 572.

The highband LPC analyzer 573 performs a LPC analysis for highband voice frames and generates highband LPC coefficients for the frame.

The highband type converter 574 converts the highband LPC coefficients vector analyzed by the highband LPC analyzer 573 into a highband LSP vector which is a parameter type proper to vector quantization. By repeating the process from the highband LPC analyzer 573 to the highband type converter 574 for every frame of all the 16 kHz highband voice samples in the lowband voice DB 562, the highband LSP DB 575 is created. The highband LSP DB 575 stores the LSP coefficients vectors for all of the 16 kHz highband voice samples in the highband voice DB as training set.

Each highband LSP coefficients vector in the highband LSP DB 575 is one-to-one mapped to each lowband LSP coefficients vector in the lowband LSP DB 565.

The highband VO trainer 576 generates the highband codebook 577 by calculating a mean value of the LSP coefficient vectors corresponding to each class based on the class information passed from the lowband VO trainer 566. The lowband codebook 567 and the highband codebook 577 can be queried by the identical index. The process for generating the highband LPC coefficient is based on the mutual correlation of the lowband information and the highband information of the voice signals.

As above-mentioned, the method of the present invention can be embodied as a program and stored in recording media readable by a computer, e.g., CD-ROM, RAM, floppy disk, hard disk, magneto-optical disk, etc.

The present invention decrease the voice quality degradation due to the packet loss and the frame error in highband of the spilt-band voice codec so that provides high quality wideband voice telecommunication and can be applicable to any kind of highband voice coding scheme e.g., CELP, Transform coding, and waveform coding, etc.

The present application contains subject matter related to Korean patent application no. 2003-97824, filed in the Korean Intellectual Property Office on Dec. 26, 2003, the entire contents of which being incorporated herein by reference.

While the present invention has been described with respect to certain preferred embodiments, it will be apparent to those skilled in the art that various changes and modifications may be made without departing from the scope of the invention as defined in the following claims.

What is claimed is:

1. An apparatus for concealing a highband error in a spilt-band wideband voice codec, the apparatus comprising:

a lowband LPC coefficient extracting means for extracting a lowband linear predictive coding (LPC) coefficient from a lowband voice signal passed by a lowband decoding means;

a highband excitation signal generating means for generating a highband excitation signal based on the lowband voice signal and the lowband LPC coefficient;

a highband LPC coefficient generating means for generating a highband LPC coefficient based on the lowband LPC coefficient;

a highband voice synthesizing means for synthesizing a highband voice signal based on the highband excitation signal and the highband LPC coefficient; and a high pass filtering means for removing a lowband component of the synthesized highband voice signal by the highband voice synthesizing means and generating the synthesized highband voice signal.

2. The apparatus as recited in claim 1, wherein the highband excitation signal generating means includes:

a first analysis filtering means for generating a lowband excitation signal using the lowband voice signal and the lowband LPC coefficient;

a first up-sampling means for converting a sampling rate of the lowband excitation signal from 8 kHz to 16 kHz in order to generate a spectral mirror image of the lowband excitation signal in highband; and a first high pass filtering means for removing a lowband component of the up-sampled excitation signal and generating the highband excitation signal in 16 kHz.

3. The apparatus as recited in claim 1, wherein the highband excitation signal generating means includes:

a second analysis filtering means for generating a lowband excitation signal based on the lowband voice signal and the lowband LPC coefficient;

a second up-sampling means for converting the sampling frequency of the lowband excitation signal from 8 kHz into 16 kHz in order to generate a spectral mirror image of the lowband excitation signal in highband;

a low pass filtering means for removing a highband component of the 16 kHz up-sampled excitation signal and generating lowband excitation signal in 16 kHz;

a nonlinear distorting means for generating a highband component of the lowband excitation signal from the low pass filtering means by distorting the lowband excitation signal using the nonlinear function; and a second high pass filtering means for removing a lowband component of the distorted highband excitation signal, to thereby generate the highband excitation signal.

4. The apparatus as recited in claim 1, wherein the highband LPC coefficient generating means includes:

a first type converting means for converting the lowband LPC coefficient vector into a line spectral pair (LSP) coefficient vector;

a lowband codebook searching means for searching a codeword vector which is the most similar to the lowband LSP coefficient vector in the lowband codebook and generating an index of the searched codeword vector;

a highband codebook searching means for searching a highband LSP codeword vector corresponding to the index of the codeword vector searched by the lowband codebook searching means in the highband codebook;

a second type converting means for converting the highband LSP codeword into a highband LPC coefficient;

a lowband codebook storing means for storing a set of a lowband LSP codeword vectors trained by a codebook training block means; and a highband codebook storing means for storing a set of a highband LSP codeword vectors trained by the codebook training block means.

5. The apparatus as recited in claim 4, wherein the codebook training block means includes:

a low pass filtering means for removing a highband component of a voice sample stored at a wideband voice storing means and generating the lowband voice signal in 16 kHz;

a down-sampling means for converting a sampling frequency of the lowband voice signal filtered by the low pass filtering means from 16 kHz to 8 kHz and then the down-sampled lowband voice signal is stored at a lowband voice storing means;

a lowband LPC analyzing means for extracting a lowband LPC coefficient from the lowband voice signal converted by the down-sampling means;

a lowband type converting means for converting the type of lowband LPC coefficient from LPC to LSP appropriate to vector quantization and the lowband LSP coefficients vector is stored at a lowband LSP storing means;

a lowband vector quantization training means for separating all the lowband LSP vectors in the lowband LSP storing means into groups representing classes and calculating the representatives of each class and then outputting class information which each LSP vector belongs to;

a high pass filtering means for removing a lowband component of a voice sample stored at the wideband voice storing means and generating the highband voice signal in 16 kHz;

a highband LPC analyzing means for extracting a highband LPC coefficient from the highband voice signal converted by the high pass filtering means;

a highband type converting means for converting the type of highband LPC coefficient from LPC to LSP appropriate to the vector quantization and the highband LSP coefficients vector is stored at a highband storing means; and a highband vector quantization training means for generating the highband codebook by calculating the representatives of each class using all highband LSP vectors in the highband LSP storing means based on the class information passed from the lowband vector quantization training means.

6. A method for concealing a highband error in spilt-band wideband voice codec, the method comprising the steps of:

a) extracting a lowband linear predictive coding (LPC) coefficient from a lowband voice signal transmitted from a lowband decoding means;

b) generating a highband excitation signal based on the lowband voice signal and the low band LPC coefficient;

c) generating a highband LPC coefficient based on the lowband LPC coefficient;

d) synthesizing a highband voice signal based on the highband excitation signal and the highband LPC coefficient and e) removing a lowband component of the synthesized highband voice signal passed by the highband voice synthesizing means and outputting the synthesized highband voice signal.

7. A bit stream decoding system using an apparatus for concealing a highband error, the system comprising:

a packet loss detecting means for detecting a packet loss of an input bit stream;

a demultiplexing means for demultiplexing the input bit stream into a highband bit stream and a lowband bit stream by analyzing the input stream for every frame;

a lowband decoding means for decoding the lowband bit stream passed from the demultiplexing means into a lowband voice signal;

a highband error detecting means for detecting a highband error by checking the highband bit stream passed from the demultiplexing means and determining whether the input bit stream has an error;

a first selecting means for selecting an apparatus to decode the highband bit stream based on outputs of the packet loss detecting means and the highband error detecting means;

a highband error concealing means for concealing an error in a highband frame or lost frame;

a second selecting means for selecting an apparatus to output a synthesized highband voice based on the outputs of the packet loss detecting means and the highband error detecting means; and a combining means for outputting a synthesized wideband voice signal by combining the synthesized lowband voice signal and the synthesized highband voice signal.

8. The system as recited in claim 7, wherein the first selecting means controls the highband decoding means to be operated if the packet loss detecting means detects no packet loss and the highband error detecting means detects no error, and controls the highband error concealing means to be operated otherwise.

9. The system as recited in claim 8, wherein the highband error concealing means includes:

a lowband LPC coefficient extracting means for extracting a lowband linear predictive coding (LPC) coefficient of the lowband voice signal transmitted from a lowband decoding means;

a highband excitation signal generating means for generating a highband excitation signal based on the lowband voice signal and the lowband LPC coefficient;

a highband LPC coefficient generating means for generating a highband LPC coefficient based on the lowband LPC coefficient;

a highband voice synthesizing means for synthesizing a highband voice signal based on the highband excitation signal and the highband LPC coefficient; and a high pass filtering means for removing a lowband component of the synthesized highband voice signal passed by the highband voice synthesizing means and outputting the synthesized highband voice signal.

10. The system as recited in claim 9, wherein the second selecting means transmits the synthesized highband voice signal synthesized by the highband decoding means, the upsampling means and the high pass filtering means if the packet loss detecting means detects no packet loss and the highband error detecting means detects no error, and transmits the synthesized highband voice signal synthesized by the highband error concealing means otherwise.

* * * * *